US007717545B2

(12) United States Patent
Okazawa

(10) Patent No.: US 7,717,545 B2
(45) Date of Patent: May 18, 2010

(54) LIQUID EJECTING HEAD AND LIQUID EJECTING APPARATUS

(75) Inventor: Noriaki Okazawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 238 days.

(21) Appl. No.: 12/056,097

(22) Filed: Mar. 26, 2008

(65) Prior Publication Data

US 2008/0239019 A1 Oct. 2, 2008

(30) Foreign Application Priority Data

Mar. 27, 2007 (JP) ..... 2007-082765

(51) Int. Cl.
*B41J 2/045* (2006.01)

(52) U.S. Cl. ..... 347/70; 347/68

(58) Field of Classification Search ..... 347/70, 347/68, 69, 71–72; 400/124.14–124.16; 310/363–366

See application file for complete search history.

(56) References Cited

U.S. PATENT DOCUMENTS 6,139,132 A 10/2000 Yasukawa et al.
6,460,981 B1 10/2002 Yasukawa et al.
6,547,373 B2 * 4/2003 Kitahara ..... 347/68
6,557,985 B2 * 5/2003 Hosono et al. ..... 347/70
6,561,633 B2 5/2003 Usui
6,702,431 B1 * 3/2004 Hosono ..... 347/70
6,729,002 B1 5/2004 Yasukawa et al.

FOREIGN PATENT DOCUMENTS

JP 06-008423 1/1994
JP 06-099578 4/1994
JP 09-099557 4/1997
JP 2004-082716 3/2004

* cited by examiner

*Primary Examiner*—K. Feggins
(74) *Attorney, Agent, or Firm*—Workman Nydegger

(57) ABSTRACT

A liquid ejecting head includes a flow passage unit, a vibrator unit, a case and a reinforcing plate. The flow passage unit includes a liquid flow passage and a diaphragm portion. The liquid flow passage includes a pressure chamber that communicates with a nozzle opening. The diaphragm portion is formed at a portion corresponding to the pressure chamber and varies a volume of the pressure chamber. The vibrator unit includes a piezoelectric vibrator that is bonded to the diaphragm portion. The piezoelectric vibrator displaces the diaphragm portion. The case has an accommodation chamber formed therein to accommodate the vibrator unit. The reinforcing plate has an insertion opening portion that is formed at a position corresponding to the diaphragm portion and through which a free end portion of the piezoelectric vibrator is insertable. The reinforcing plate is interposed between the case and the flow passage unit.

8 Claims, 6 Drawing Sheets

LIQUID EJECTING HEAD AND LIQUID EJECTING APPARATUS

BACKGROUND

1. Technical Field

The present invention relates to a liquid ejecting head, such as an ink jet recording head, and a liquid ejecting apparatus and more particularly to a liquid ejecting head that is provided with a flow passage unit, which forms a continuous liquid flow passage extending from a common liquid chamber through pressure chambers to nozzle openings, and that is able to discharge liquid from the nozzle openings as liquid droplets, and a liquid ejecting apparatus.

2. Related Art

A liquid ejecting head that discharges liquid droplets from nozzle openings by generating pressure variation in the liquid contained in pressure chambers, for example, includes an ink jet recording head used for an image recording apparatus, such as a printer, a color material ejecting head used for manufacturing a color filter for a liquid crystal display, or the like, an electrode material ejecting head used for forming an electrode for an organic electro luminescence (EL) display, a field emission display (FED), or the like, and a bio-organic material ejecting head used for manufacturing a biochip, or the like.

The above described liquid ejecting heads have various types; however, for example, the ink jet recording head (hereinafter, referred to as recording head) used in an ink jet recording apparatus (hereinafter, simply referred to as printer) includes a flow passage unit that is formed by laminating a nozzle substrate, a flow passage substrate, and a diaphragm. The nozzle substrate has a plurality of nozzle openings formed therein. The flow passage substrate forms a flow passage portion, such as a pressure chamber space portion and a channel portion, which defines a continuous ink flow passage extending from a common ink chamber through pressure chambers to the nozzle openings. The diaphragm has diaphragm portions that face the pressure chambers and elastically deform in accordance with the action of pressure generating devices (for example, piezoelectric vibrators) (which may be regarded as a sealing plate that seals the opening of the flow passage substrate). Then, the flow passage unit is fixed to a head case that accommodates a vibrator unit. In the above recording head, the diaphragm portions are elastically deformed by the action of the piezoelectric vibrators that constitute the flow passage unit to thereby vary the volume of the pressure chambers. Thus, pressure variation is generated in the ink contained in the pressure chambers to thereby discharge ink droplets from the nozzle openings.

The head case is made of a plastic material that is more advantageous in terms of ease of formation, flexibility of shape and weight than a metal material. However, because a plastic material is generally lower in rigidity than a metal material, the head case may be compressively deformed due to the stress generated when the diaphragm portions are elastically deformed by the action of the piezoelectric vibrators. Particularly, compression deformation tends to occur at an open peripheral portion corresponding to the diaphragm portions in the head case. Then, there is a possibility that desired discharge characteristics of ink droplets cannot be obtained because of the occurrence of crosstalk due to the above deformation of the head case or deformation of the flow passage unit. Then, a reinforcing plate is laminated between the flow passage substrate and nozzle substrate of the flow passage unit to thereby enhance the rigidity of the head case and, as a result, the discharge characteristics of ink droplets have been attempted to improve (which is, for example, described in JP-A-6-99578).

However, when the reinforcing plate is laminated between the flow passage substrate and nozzle substrate of the flow passage unit, a flow passage also extends through the reinforcing plate and, therefore, the length of the flow passage increases. Thus, a nozzle side resistance and/or an inertance increase, so there is a problem that it becomes unsuitable for ink discharge with high response frequency or the discharge characteristics of the nozzle opening is not uniform.

In addition, as the size of the recording head increases, in the head case, the opening portion of an accommodation chamber for accommodating the vibrator unit increases. Then, as the size of the opening portion increases, the rigidity entirely decreases. Particularly, the rigidity at the center of the opening portion in the longitudinal direction is weaker than the rigidity at each end portion of the opening portion in the longitudinal direction. Therefore, there occurs a difference in the amount of displacement, or the like, between the diaphragm portions arranged at each end portion of the opening portion and the diaphragm portions arranged at the center of the opening portion. Thus, there has been a problem that uneven discharge characteristics occur among the nozzle openings.

SUMMARY

An advantage of some aspects of the invention is that it provides a liquid ejecting head and a liquid ejecting apparatus that are able to enhance the rigidity of a flow passage unit and also possible to obtain the discharge with high response frequency and/or uniform discharge characteristics.

An aspect of the invention provides a liquid ejecting head. The liquid ejecting head includes a flow passage unit, a vibrator unit, a case, and a reinforcing plate. The flow passage unit includes a liquid flow passage and a diaphragm portion. The liquid flow passage at least includes a pressure chamber that communicates with a nozzle opening. The diaphragm portion is formed at a portion corresponding to the pressure chamber and varies a volume of the pressure chamber. The vibrator unit includes a piezoelectric vibrator that is bonded to the diaphragm portion and that displaces the diaphragm portion. The case has an accommodation chamber formed therein to accommodate the vibrator unit. The reinforcing plate has an insertion opening portion that is formed at a position corresponding to the diaphragm portion and through which a free end portion of the piezoelectric vibrator is insertable. The reinforcing plate is interposed between the case and the flow passage unit.

According to the above configuration, the reinforcing plate has the insertion opening portion that is formed at a position corresponding to the diaphragm portion and through which a free end portion of the piezoelectric vibrator is insertable, and the reinforcing plate is interposed between the case and the flow passage unit. Thus, it is possible to enhance the rigidity in such a manner that the piezoelectric vibrator is surrounded by the insertion opening portion of the reinforcing plate of the opening end of the case and, thereby, it is possible to obtain the discharge with high response frequency and/or uniform discharge characteristics. In addition, by interposing the reinforcing plate between the case and the flow passage unit, there is no change in the length of a flow passage to the piezoelectric vibrator and to the nozzle opening, and it is suitable for the discharge with high response frequency.

Note that the aspect of the invention may be configured so that the reinforcing plate has a higher Young's modulus than the case and, thereby, the reinforcing plate is advantageous in that it has a reinforcing property with a Young's modulus higher than that of the case.

In addition, the reinforcing plate may be formed of a silicon substrate and, thereby, it is possible to manufacture the reinforcing plate with high accuracy by performing etching on the silicon substrate.

The aspect of the invention may be configured so that each of the case, the reinforcing plate and the flow passage unit have at least two positioning holes, wherein positions of the corresponding positioning holes of the case, the reinforcing plate and the flow passage unit are overlapped one another.

According to the above configuration, because the positions of the corresponding positioning holes of the case, the reinforcing plate and the flow passage unit are overlapped one another, it is possible to assemble the case, the reinforcing plate and the flow passage unit in a state where they are positioned with high accuracy.

In addition, the aspect of the invention may be configured so that the thickness of the reinforcing plate is set smaller than the length of the free end portion of the piezoelectric vibrator.

According to the above configuration, only with the change in configuration of the case and without changing the configuration of the existing flow passage unit, it is possible to provide the reinforcing plate.

In addition, the aspect of the invention may be configured so that the flow passage unit includes a plurality of the diaphragm portions that are provided in a column in correspondence with a plurality of the pressure chambers, wherein the reinforcing plate includes a plurality of the insertion opening portions in correspondence with the diaphragm portions of the flow passage unit.

According to the above configuration, even when the flow passage unit includes a plurality of the diaphragm portions that are provided in a column in correspondence with a plurality of the pressure chambers, by forming a plurality of the insertion opening portions in the reinforcing plate in correspondence with the diaphragm portions of the flow passage unit, it is possible to enhance the rigidity.

Note that the aspect of the invention may be configured so that a crosspiece is formed between any adjacent insertion opening portions of the reinforcing plate. Thus, owing to the crosspiece, it is possible to further enhance the rigidity.

In addition, the aspect of the invention may be configured so that the reinforcing plate has a clearance step portion that is formed on a face of the reinforcing plate, which is bonded with the flow passage unit, in an area, in which the insertion opening portion is formed, on a side of a face of the reinforcing plate, which is bonded with the case.

According to the above configuration, by forming the clearance step portion on the side of the face of the reinforcing plate, which is bonded with the case, even when the diaphragm portion displaces, it is possible to prevent the diaphragm portion from interfering with the reinforcing plate. That is, it is possible to prevent the reinforcing plate from interfering with displacement of the diaphragm portion. In this manner, it is possible to suppress the influence on the discharge characteristics of ink droplets.

Note that the aspect of the invention may be configured so that the amount of setback of the clearance step portion of the reinforcing plate from a face bonded with the flow passage unit is set larger than the amount of displacement by which the diaphragm portion is displaced by the piezoelectric vibrator toward the case. According to the above configuration, it is possible to further reliably prevent the diaphragm portion from interfering with the reinforcing plate.

In addition, an aspect of the invention provides a liquid ejecting apparatus having any one of the above configured liquid ejecting heads.

According to the above configuration, because the rigidity of the case, to which the vibrator unit that constitutes the liquid ejecting head is fitted, may be enhanced, it is possible to suppress the compression deformation of the case or the compression deformation of the flow passage unit when the discharge operation is performed by the liquid ejecting head. Thus, it is possible to discharge a prescribed amount of liquid droplets from the nozzle opening at a prescribed speed. As a result, it is possible to make the liquid droplets be placed on a discharged object with further high accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
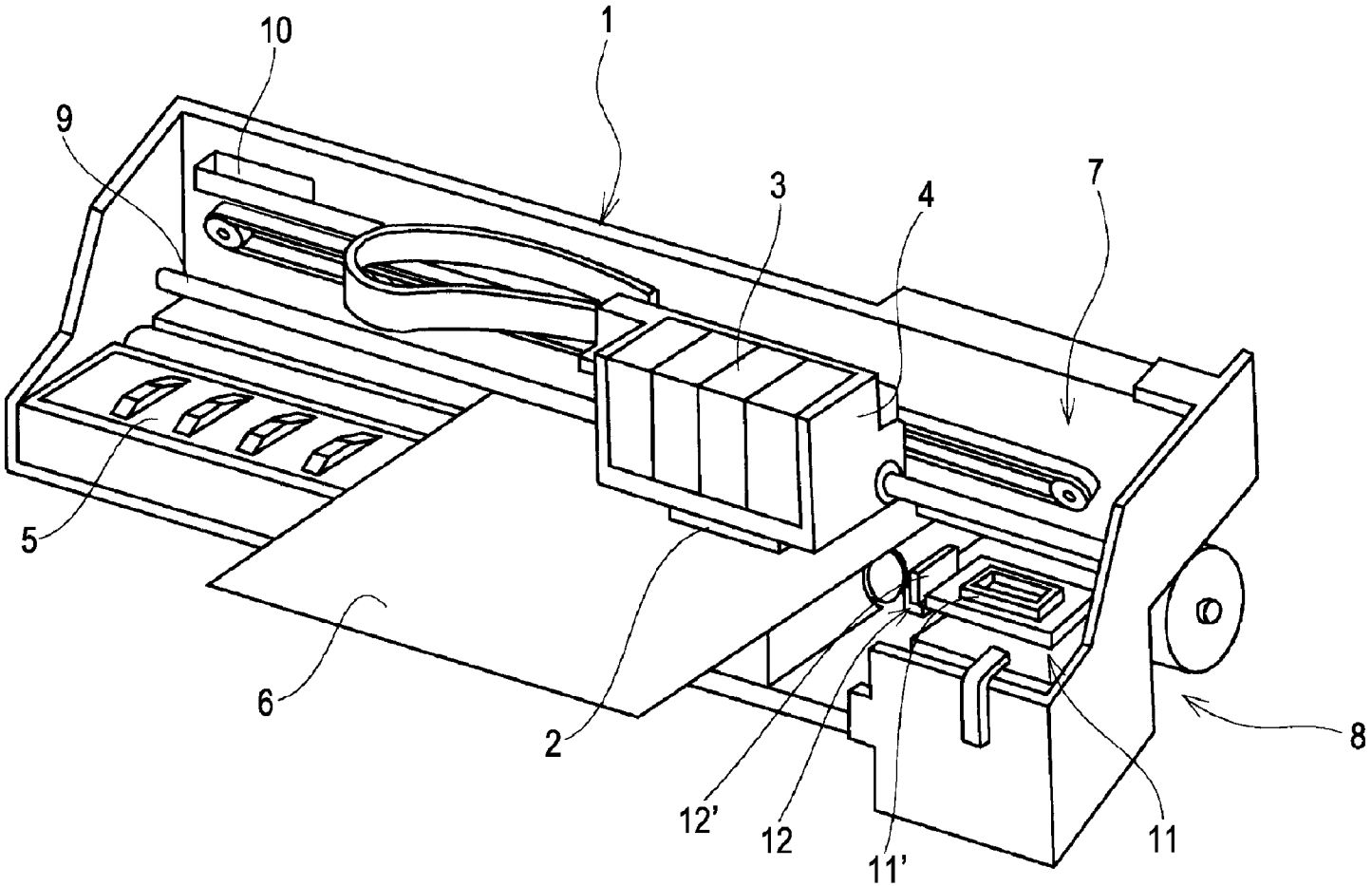
FIG. 1 is a perspective view that illustrates the configuration of a printer.

Hereinafter, embodiments according to the invention will be described with reference to the accompanying drawings. Note that, in the embodiments described below, various limitations are made as desirable specific embodiments of the aspects of the invention; however, the scope of the invention is not intended to be limited to these embodiments unless otherwise expressly stated in the description to the effect that the invention is limited. In addition, in the following description, an ink jet printer (hereinafter, simply referred to as printer) shown in FIG. 1 is exemplified as a liquid ejecting apparatus according to the aspects of the invention.

The printer 1 has an installed recording head 2, which is a kind of liquid ejecting head, and schematically includes a carriage 4, a platen 5, a carriage moving mechanism 7, a paper feed mechanism 8, and the like. An ink cartridge 3 is detachably mounted on the carriage 4. The platen 5 is arranged below the recording head 2. The carriage moving mechanism 7 moves the carriage 4, on which the recording head 2 is mounted, in a paper width direction of a sheet of recording paper 6 (a kind of discharged object). The paper feed mechanism 8 transports the sheet of recording paper 6 in a paper feed direction which is a direction perpendicular to the paper width direction. Here, the paper width direction is a main scanning direction (head scanning direction), and the paper feed direction is a sub scanning direction (that is, a direction perpendicular to the head scanning direction). Note that the ink cartridge 3 may employ a type that is attached to the carriage 4 or may employ a type that is attached to the case of the printer 1 and supplies the recording head 2 through an ink supply tube.

The carriage 4 is mounted so that it is pivotally connected to a guide rod 9 that extends in the main scanning direction.

The carriage 4 is configured to move in the main scanning direction along the guide rod 9 by the action of the carriage moving mechanism 7. The position of the carriage 4 in the main scanning direction is detected by a linear encoder 10, and a detection signal is transmitted to a control portion (not shown) as positional information. In this manner, the control portion is able to recognize a scanning position of the carriage 4 (recording head 2) on the basis of the positional information from the linear encoder 10 and to control a recording operation (discharging or ejecting operation), or the like, by the recording head 2.

In addition, a home position, which is a scanning start point (rest position when no recording is performed) of the recording head 2, is set within a movable range of the recording head 2 and outside the platen 5. At this home position, a capping mechanism 11 is provided. The capping mechanism 11 seals the nozzle forming face of the recording head 2 by a cap member 11' to thereby prevent vaporization of ink solvent from nozzle openings 19 (see FIG. 2). In addition, the capping mechanism 11 is used for a cleaning operation in which a negative pressure is applied to a sealed nozzle face to thereby forcibly sucks and drains ink from the nozzle openings 19.

In addition, at the home position, a wiping mechanism 12 that wipes the nozzle forming face of the recording head 2 is arranged. The wiping mechanism 12 is provided with a wiper blade 12', which is, for example, formed of an elastic material, such as elastomer. The wiping mechanism 12 is configured so that, when the recording head 2 passes over the wiping mechanism 12, the upper end portion of the wiper blade 12' moves to a position (wiping position) at which the upper end portion of the wiper blade 12' is able to contact the nozzle forming face of the recording head 2. Then, when the recording head 2 moves in a state where the upper end portion of the wiper blade 12' is in contact with the nozzle forming face of the recording head 2, the nozzle forming face of the recording head 2 is wiped by the wiper blade 12'. In this manner, it is possible to remove, for example, redundant ink droplets adhered on the nozzle forming face after cleaning operation.

Figure 2:
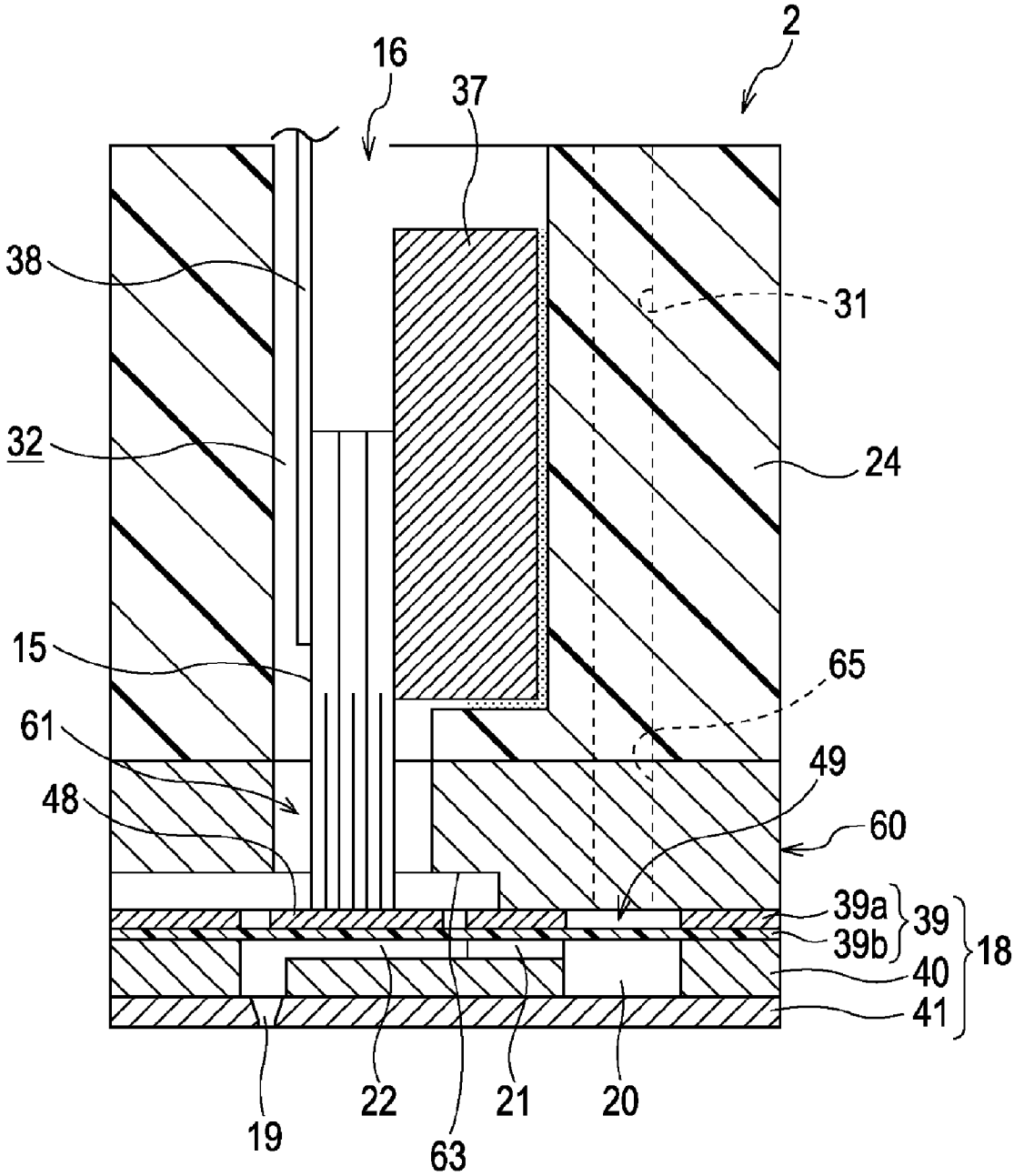
FIG. 2 is a cross-sectional view of a relevant portion, illustrating the configuration of a recording head.
Figure 3:
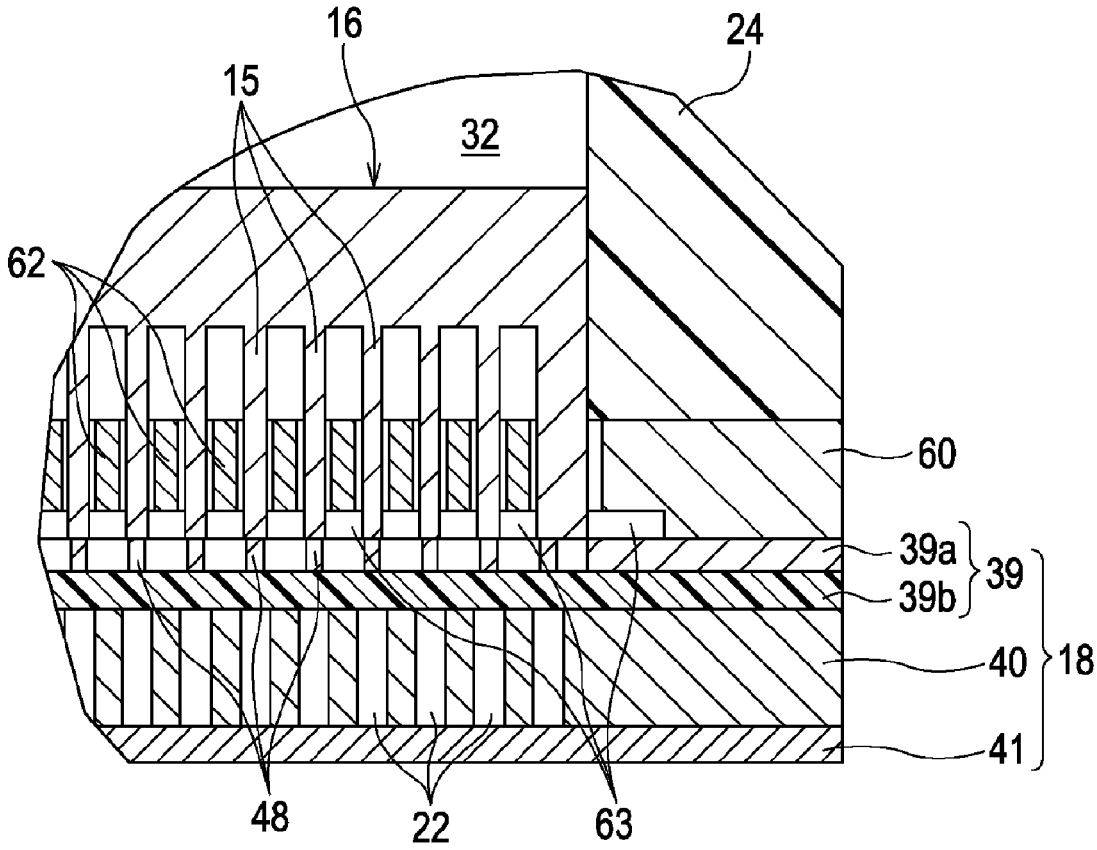
FIG. 3 is a longitudinal cross-sectional view of a relevant portion, illustrating the configuration of the recording head.
Figure 4:
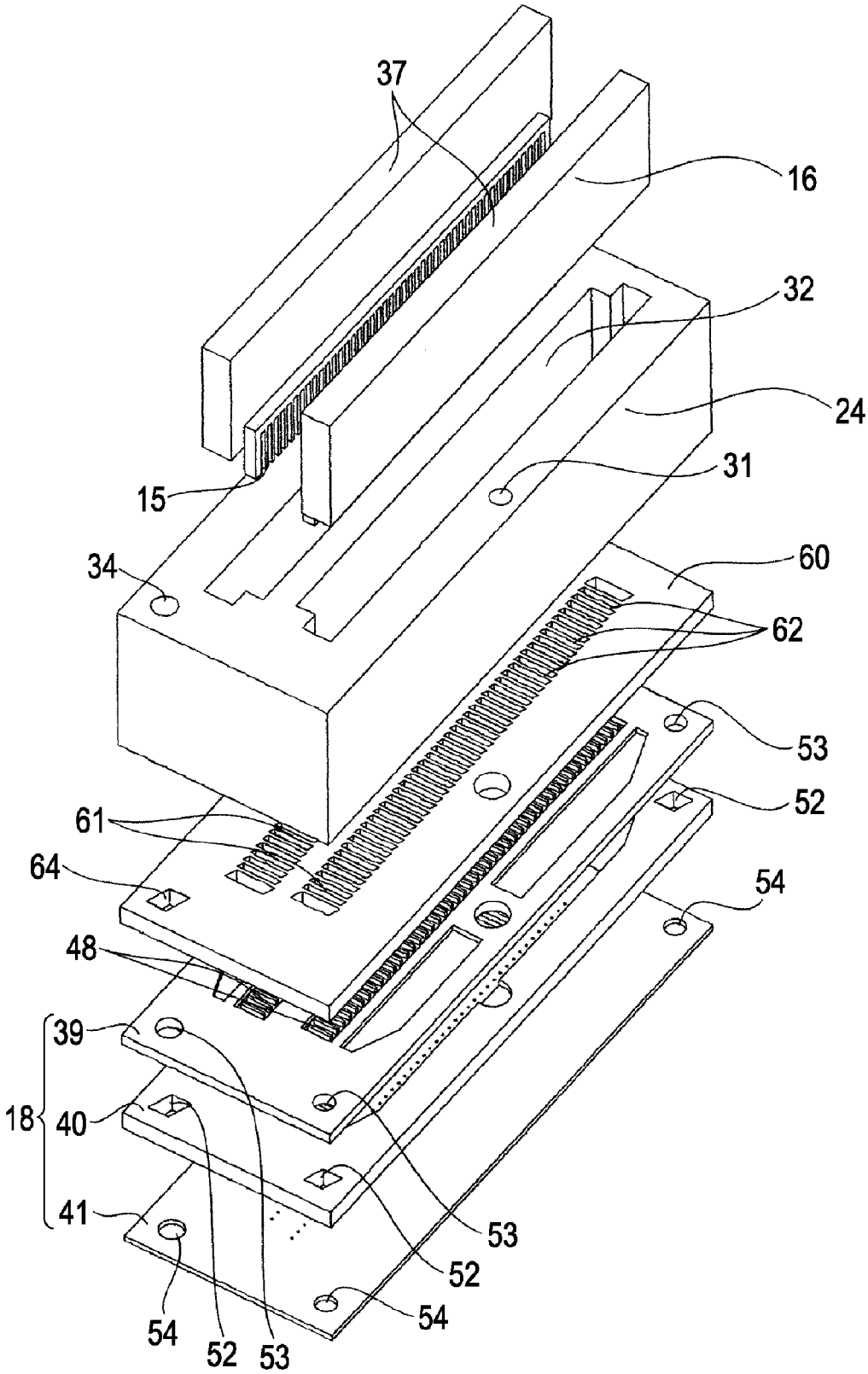
FIG. 4 is an exploded perspective view of a flow passage unit, a reinforcing plate and a case unit.

FIG. 2 is a cross-sectional view of a relevant portion, illustrating the configuration of the recording head 2. FIG. 3 is a longitudinal cross-sectional view of a relevant portion, illustrating the configuration of the recording head 2. FIG. 4 is an exploded perspective view of the flow passage unit 18 and the head case 24. The recording head 2 according to the present embodiment schematically includes actuator units 16, each of which has a plurality of piezoelectric vibrators 15, a flow passage unit 18 that forms a continuous ink flow passage (a kind of liquid flow passage) that extends from a common ink chamber 20 (common liquid chamber) through ink supply ports 21 and pressure chambers 22 to nozzle openings 19, a head case 24, and the like.

The head case 24 is a hollow box-shaped casing, and has case flow passages 31, which are formed therein, and accommodation chambers 32. The case flow passages 31 each are a flow passage for introducing ink from the ink cartridge 3 toward the common ink chamber 20. The accommodation chambers 32 each accommodate the actuator unit 16. The head case 24 is formed of a plastic material, such as epoxy resin, which is a kind of thermosetting resin, and the flow passage unit 18 is fixed on the flow passage fitting face of the head case 24. In addition, the head case 24 has two pin retaining portions 34 (which also serve as positioning holes) that are formed therein and that extend through in the height direction of the case, as shown in FIG. 4 (in FIG. 4, only one of two pin retaining portions 34 is shown). These pin retaining portions 34 are space portions for respectively retaining case pins (not shown) and each are formed into a cylindrical shape of which an inner diameter is slightly larger than the diameter of the case pin. In the present embodiment, the two pin retaining portions 34 are respectively provided at positions corresponding to reference holes 52 (see FIG. 4) formed in the flow passage substrate 40. Then, each case pin is implanted into the pin retaining portion 34 and is retained in a state where the distal end portion protrudes from the flow passage fitting face. Positioning may be performed by matching the diameters of the case pins to the diameters of the inscribed circles of the corresponding reference holes 52. Note that positioning of the flow passage unit 18 with the head case 24 will be described later.

Each of the above actuator units 16 includes piezoelectric vibrators 15, a fixed plate 37 to which these piezoelectric vibrators 15 are bonded, flexible cables 38 for supplying driving signals from a wiring substrate to the piezoelectric vibrators 15, and the like. Each piezoelectric vibrator 15 is connected to the fixed plate 37, which is formed of a metal plate material, such as stainless steel, in a state of a so-called cantilever such that a free end portion of each piezoelectric vibrator 15 protrudes outside the distal end face of the fixed plate 37. Note that the pressure generating device may employ an electrostatic actuator, a magnetostrictive element, or the like, other than the above piezoelectric vibrator.

The flow passage unit 18 is formed so that a lamination of flow passage unit components composed of a diaphragm 39, a flow passage substrate 40 and a nozzle substrate 41 is bonded and integrated. The pressure chambers 22 of the flow passage unit 18 are formed as long narrow chambers extending in a direction perpendicular to a column array direction (nozzle array direction) of the nozzle openings 19. In addition, the common ink chamber 20 is a chamber into which ink is introduced from the side of an ink introducing needle. Then, ink introduced into the common ink chamber 20 is separately supplied through the ink supply ports 21 to the pressure chambers 22.

The nozzle substrate 41 that is arranged at the bottom of the flow passage unit 18 is a metal thin plate material in which the plurality of nozzle openings 19 are formed in a column in the sub scanning direction at a pitch corresponding to the density of dot formation. The nozzle substrate 41 of the present embodiment is formed of a stainless plate material, and a plurality of the columns (nozzle columns) of the nozzle openings 19 are provided and aligned along the scanning direction (main scanning direction) of the recording head 2. Then, one nozzle column is, for example, formed of 180 nozzle openings 19.

The flow passage substrate 40 in the present embodiment is a plate-like member in which a flow passage portion that forms ink flow passages, that is, specifically, an opening portion that serves as the common ink chamber 20, channel portions that serve as ink supply ports 21 and pressure chamber space portions that serve as the pressure chambers 22 are defined. The flow passage substrate 40 is formed by performing anisotropic etching on a silicon wafer, which is a kind of crystalline base material.

The above diaphragm 39 is, as shown in FIG. 2, a double layer structure composite plate material in which an elastic film 39*b*, such as a PPS resin, is laminated on a support plate 39*a* made of metal, such as stainless steel. In the diaphragm 39, island portions 48 for bonding the distal ends of the free end portions of the piezoelectric vibrators 15 are formed at portions corresponding to the pressure chambers 22, and the above portions function as diaphragm portions. That is, the diaphragm 39 is configured so that elastic films around the island portions 48 elastically deform in accordance with the action of the piezoelectric vibrators 15. In addition, the diaphragm 39 seals the open portion of the common ink chamber 20 of the flow passage substrate 40 and also serves as a compliance portion 49 as well. A portion of the diaphragm 39 corresponding to the compliance portion 49 is only formed of the elastic film 39*b* by removing the support plate 39*a*. Note that the diaphragm 39 may be regarded as a sealing plate that seals the opening face of the flow passage portion 43 formed in the flow passage substrate 40.

Here, in each of the above flow passage substrate 40, four reference holes 52 in total for specifying the relative position with the diaphragm 39, the nozzle substrate 42 and the head case 24 are formed in a frame region, which is a region located outside the region in which the flow passage portion 43 is formed (flow passage portion forming region), as shown in FIG. 4 (in FIG. 4, three of the four reference holes 52 are shown). Then, the two reference holes 52 located on one long side (left side) of the flow passage substrate 40 are reference holes that are used when the flow passage unit 18 and the head case 24 are positioned, while, on the other hand, the two reference holes 52 located on the other long side (right side) are reference holes that are used when the components of the flow passage unit 18 are positioned. In this manner, by using two reference holes, which are used as a reference when positioning, that are located on any one of the long sides and that are spaced apart in long distance from each other, it is attempted to improve the positioning accuracy.

On the other hand, as shown in FIG. 4, in the diaphragm 39 and the nozzle substrate 41, four through holes 53 and four through holes 54 are respectively formed at positions corresponding to the reference holes 52 of the flow passage substrate 40. Then, when these flow passage unit components are bonded, the components are sequentially laminated on a jig.

In the present embodiment, first, in a state where positioning pins provided for the jig are respectively inserted into the through holes 54 on the other long side, the nozzle substrate 41 is laminated on a flow passage unit mounting face of the jig. Subsequently, the positioning pins are respectively inserted into the reference holes 52 on the other long side, and, in a state where an adhesive is interposed in between, the flow passage substrate 40 is mounted on the nozzle substrate 41. Then, the positioning pins are respectively inserted into the through holes 53 on the other side, and, in a state where an adhesive is interposed in between, the diaphragm 39 is mounted on the flow passage substrate 40.

In this manner, the nozzle substrate 41, the flow passage substrate 40 and the diaphragm 39 are bonded one another in a state where their relative positions are specified, so that the flow passage unit 18 is assembled.

In the recording head 2, a reinforcing plate 60 is interposed between the head case 24 and the flow passage unit 18. Thus, compression deformation of the head case 24 or deformation of the flow passage unit 18 because of the action of the piezoelectric vibrators 15 of each vibrator unit that is fixedly accommodated in the accommodation chamber 32 of the head case 24 is suppressed. The reinforcing plate 60 is a plate-like member having insertion opening portions 61 that are formed at positions corresponding to island portions 48 that serve as diaphragm portions. The free end portions of the piezoelectric vibrators 15 are insertable through the insertion opening portions 61. In this reinforcing plate 60, the plurality of insertion opening portions 61 are provided and arranged at positions corresponding to the island portions 48, which serve as the diaphragm portions of the flow passage unit 18. Then, a crosspiece 62 is formed between any adjacent insertion opening portions 61, and reinforcement is achieved by partitioning the insertion opening portions 61 with the crosspieces 62. The thickness of the reinforcing plate 60 is set smaller than the length of the free end portion of each piezoelectric vibrator 15. Thus, in a state where the reinforcing plate 60 is interposed between the head case 24 and the flow passage unit 18, it is possible to closely adhere and bond the distal ends of the free end portions of the piezoelectric vibrators 15 with the island portions 48 of the diaphragm 39. That is, the flow passage unit 18 includes a plurality of the diaphragm portions that are provided in a column in correspondence with a plurality of the pressure chambers, and the reinforcing plate 60 includes a plurality of the insertion opening portions 61 in correspondence with the diaphragm portions of the flow passage unit 18. In addition, communication flow passages 65 are formed in the reinforcing plate 60 in correspondence with the case flow passages 31.

In order to enhance the flow passage fitting face of the flow passage unit 18 of the head case 24, the reinforcing plate 60 is formed of a material having a higher Young's modulus than the head case 24 made of plastic. The reinforcing plate 60 of the present embodiment is formed so that the insertion opening portions 61, through which the free end portions of the piezoelectric vibrators 15 are inserted, and the crosspieces 62 that partition the insertion opening portions 61 are made by performing anisotropic etching process on a silicon substrate (silicon wafer), which is a kind of crystalline base material. Note that, in place of the silicon substrate, the reinforcing plate 60 may be, for example, formed of another material, such as stainless steel (SUS).

In addition, in the reinforcing plate 60, a clearance step portion 63 is formed on its flow passage fitting face fitted with the flow passage unit 18 in an area, in which the insertion opening portions 61 are formed, on the side of the head case 24. The amount of setback of the clearance step portion 63 from the face bonded with the flow passage unit 18 is set larger than the amount of displacement by which the piezoelectric vibrators 15 are displaced toward the head case 24 of the island portions 48 to thereby prevent the piezoelectric vibrators 15 from interfering with the insertion opening portions 61 or the crosspieces 62.

Furthermore, the reinforcing plate 60 has two reference holes 64, as positioning holes for positioning between the head case 24 and the flow passage unit 18, and, as shown in FIG. 4, the two reference holes 64 are formed on one long side (right side) at which the reference holes 64 may be overlapped in correspondence with the reference holes 52 of the flow passage substrate 40 of the flow passage unit 18.

Figure 5A:
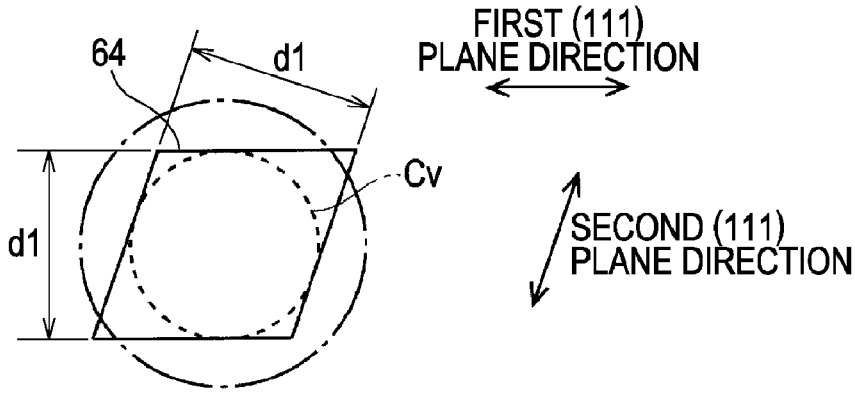
FIG. 5A and FIG. 5B are views, each of which illustrates a reference hole.

At least one of the two reference holes 64 is formed in a polygonal shape having equal length of sides such that, as shown in FIG. 5A, the polygonal shape is formed of, on the surface (110) plane of the silicon wafer of the reinforcing plate 60, a first (111) plane that is perpendicular to the surface (110) plane and a second (111) plane that obliquely intersects with the first (111) plane at an angle of 70.53 degrees and that is perpendicular to the surface of the silicon wafer. In the present embodiment, the reference holes 64 are formed in a rhombic shape having four sides of equal length. The dimension of each reference hole 64 is determined so that a perpendicular distance between the opposite sides is d1. In other words, the dimension of the hole is determined so that the diameter of an imaginary inscribed circle Cv that inscribes the reference hole 64 is d1. The diameter d1 of the inscribed circle Cv is made equal to the diameter of the positioning pin of the assembling jig and the diameter of the case pin of the head case 24. That is, each reference hole 64 is set to a dimension such that rattling does not occur with respect to the positioning pin and/or the case pin.

Figure 5B:
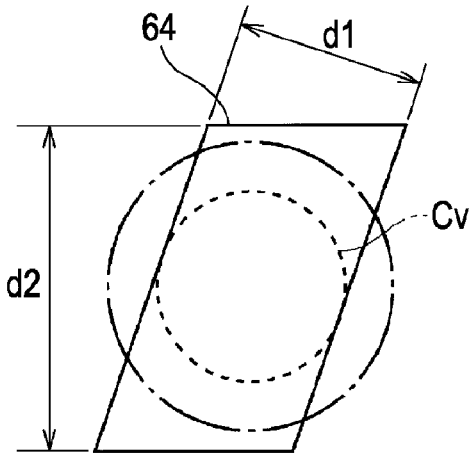

In addition, at least the other one of the two reference holes 64 may be different in shape from the above reference hole 64, as shown in FIG. 5B, or may have a polygonal shape having sides of different length. In the present embodiment, the other one of two reference holes 64 is formed in a parallelogram oblong hole, the short side of which is defined by a first (111) plane and the long side of which is defined by a second (111) plane. The dimension of the short side of the above reference hole 64 is made equal to the dimension of each side of the above described reference hole 64. Specifically, the perpendicular distance between the opposite long sides is set to d1, while, on the other hand, the perpendicular distance between the opposite short sides is set to d2 that is longer than d1. Thus, when at least one of the two reference holes 64 of the reinforcing plate 60 is formed in a rhombic shape having four sides of equal length, the remaining one may be a polygonal shape having sides of different length, for example, a parallelogram oblong hole having a short side of which the length is equal to that of the reference hole 64 having a rhombic shape and a long side of which the length is different from that of the reference hole 64 having a rhombic shape. Alternatively, the two reference holes 64 all may be a rhombic shape.

When the head case 24, the reinforcing plate 60 and the flow passage unit 18 are positioned with one another, using the two reference holes 64, arranged on the long side, of the reinforcing plate 60, the reinforcing plate 60 is bonded to the assembled flow passage unit 18 in a state where they are positioned with high accuracy and, thereafter, the reinforcing plate 60 is bonded to the head case 24. Thus, it is possible to perform assembling in a state where it is positioned with high accuracy. The components of the flow passage unit 18 are laminated on the jig, when an adhesive between the components is hardened, the flow passage unit 18 is positioned using the reference holes 64 and then bonded. Then, these flow passage unit 18 and the reinforcing plate 60 are removed from the jig. After that, in a state where the diaphragm side faces the head case 24, the reinforcing plate 60 is bonded to the flow passage fitting face of the head case 24. At this time, by inserting the case pins respectively into the reference holes 64 of the reinforcing plate 60, the reinforcing plate 60 and the head case 24 are fixed in a state where their relative position is specified.

In a case where the reinforcing plate 60 and the flow passage unit 18 are positioned and when the reinforcing plate 60 and the head case 24 are positioned, when one of the two reference holes 64 is formed as a parallelogram hole, the oblong hole resulting from the long side allows a gap to be formed between the parallelogram hole and the case pin of the head case 24. Thus, even when there is a small tolerance, it is possible to absorb the tolerance by this gap. In this manner, without forming a crazing or a crack in the reinforcing plate 60 and/or the flow passage substrate 40, it is possible to perform assembling in a state where positioning is made with high accuracy.

Here, when, among the two reference holes 64, one reference hole 64 is formed as an oblong hole, it is elongated obliquely (second (111) plane direction). Therefore, when the center of the oblong reference hole 64 is deviated from the central axis of the case pin while positioning, there is a possibility that the position of the reinforcing plate 60 and the flow passage unit 18 may be deviated in a rotating direction about the case pin with respect to the head case 24. However, the positional accuracy required between the flow passage unit 18 and the head case 24 is not as high as the positional accuracy required between the flow passage unit components, so that the above deviation in position is allowable. In addition, because the layout is made in such a manner that the distance between the two reference holes becomes long as much as possible, it is possible to suppress the adverse effect due to a deviation in position to a minimum degree.

In the above configured recording head 2, because the reinforcing plate 60 having the insertion opening portions 61, through which the free end portions of the piezoelectric vibrators 15 are insertable, at positions corresponding to the island portions 48, which serve as the diaphragm portions, is interposed between the head case 24 and the flow passage unit 18, the free end portions of the piezoelectric vibrators 15 are surrounded by the insertion opening portions 61 of the reinforcing plate 60 of the opening end of the head case 24 and the crosspieces 62 that partition the insertion opening portions 61. Thus, it is possible to enhance the rigidity of the head case 24 and flow passage unit 18. In this manner, it is possible to prevent the compression deformation of the head case 24 or the flow passage unit 18 due to the action of the piezoelectric vibrators 15, and it is possible to obtain the discharge with high response frequency and/or uniform discharge characteristics. That is, it is possible to uniform the discharge characteristics of the pressure chambers (nozzle openings).

Particularly, because the opening edge of the accommodation chamber 32 of the head case 24 may be reinforced, it effectively prevents deformation of the flow passage unit 18, and, because it is possible to uniform the discharge characteristics of the pressure chambers, it is suitable for the case in which a large-sized head, such as a line head, in which the shape of the opening of the accommodation chamber 32 is further large. In addition, in the recording head 2, because the reinforcing plate 60 is interposed between the head case 24 and the flow passage unit 18, without increasing the thickness of the flow passage unit 18 and the length of a flow passage from the distal end of each piezoelectric vibrator 15 to the corresponding nozzle opening 19, it is possible to obtain the characteristic that is also advantageous in terms of high frequency response, or the like.

Furthermore, in the recording head 2, because the reinforcing plate 60 is formed of a material having a higher Young's modulus than the head case 24 made of plastic, it is possible to reinforce the flow passage fitting face of the head case 24. Particularly, by forming the reinforcing plate 60 using a silicon substrate, it is possible to manufacture the insertion opening portions 61 and the crosspieces 62 for the piezoelectric vibrators 15 by etching with high accuracy and, therefore, it is possible to minimize a gap between the insertion opening portions 61 or the crosspieces 62 and the piezoelectric vibrators 15 to thereby improve the rigidity. Then, because the clearance step portion 63 is formed on the reinforcing plate 60 adjacent to the flow passage fitting face, the island portions 48, when displaced by the piezoelectric vibrators 15, do not interfere with the reinforcing plate 60. Thus, it is possible to further reduce the gap between the insertion opening portions 61 or the crosspieces 62 and the piezoelectric vibrators 15 and, therefore, it is possible to further effectively prevent the compression deformation of the head case 24 or the reinforcing plate 60.

In addition, in the recording head 2, because two reference holes 64 are formed as positioning holes along the long side of the reinforcing plate 60, it is possible to assemble the flow passage unit 18 with the positioning holes that are overlapped using these reference holes 64 as a reference and also possible to assemble the head case 24 with the overlapped positioning holes. Thus, it is possible to assemble the case, the reinforcing plate and the flow passage unit in a state where they are positioned with high accuracy.

Figure 6:
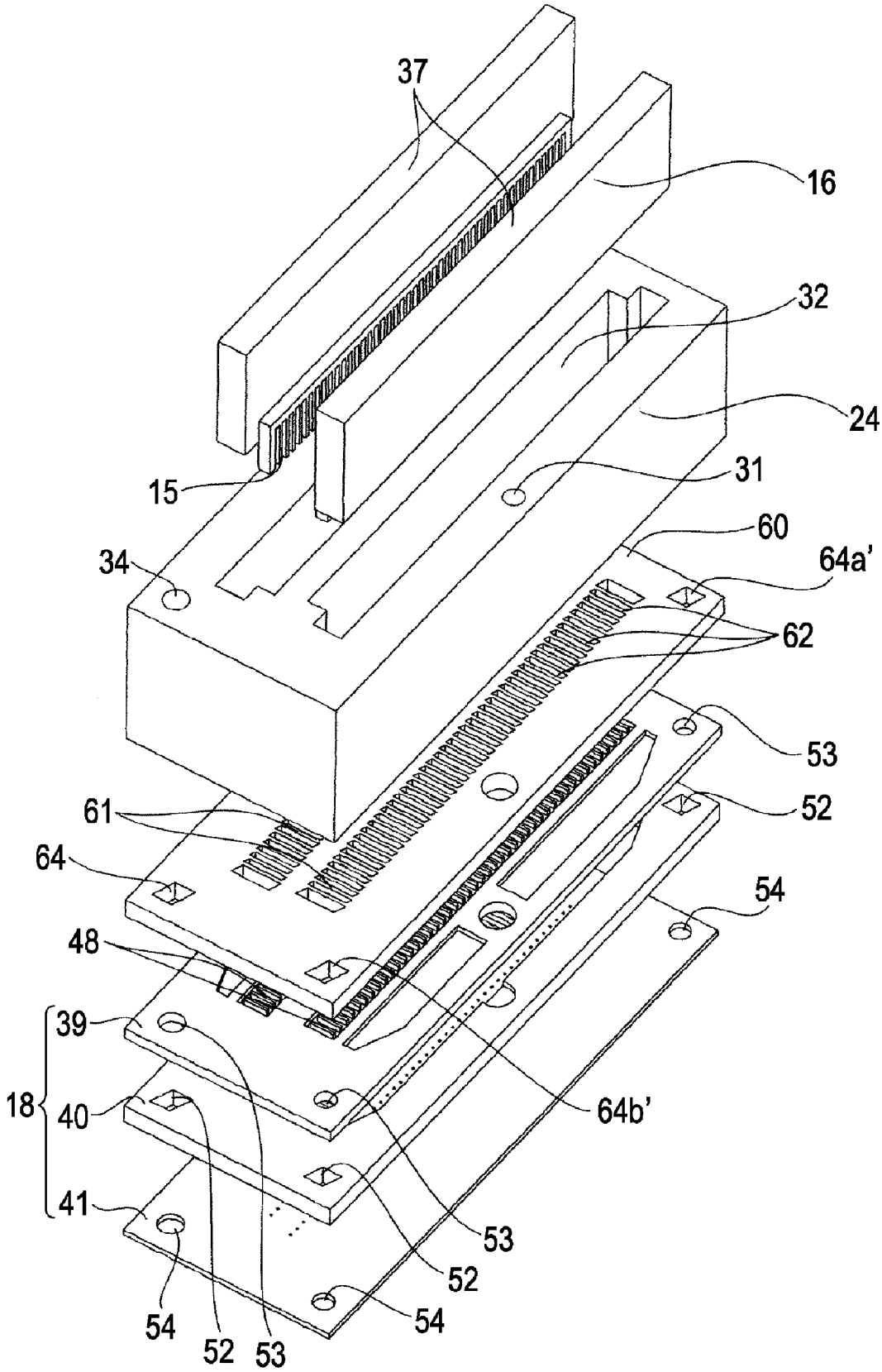
FIG. 6 is a view that illustrates an alternative example embodiment of a reinforcing plate.

Note that, in the above described embodiments, when the accuracy of positioning holes (the accuracy of position or shape) of the reinforcing plate 60 is sufficiently ensured, it is applicable that, as shown in FIG. 6, positioning holes 64*a*', 64*b*' are formed at positions corresponding to two reference holes 52 located on the other long side of the flow passage substrate 40 on the reinforcing plate 60, and, using the positioning holes 64*a*', 64*b*', the flow passage unit 18 and the reinforcing plate 60 are integrated and, after that, using the reference holes 64, the head case 24 and the reinforcing plate 60 are bonded. In this case, the dimension of these reference holes 64 are set larger than the reference holes 52 of the flow passage substrate 40. In addition, one positioning hole 64*a*' is formed in a rhombic shape having four sides of equal length, and the other positioning hole 64*b*' is set in a parallelogram oblong hole. That is, the positioning hole 64*a*' is formed in a shape shown in FIG. 5A, and the positioning hole 64*b*' is formed in a shape shown in FIG. 5B.

In addition, because the printer 1 may be placed in a state where the rigidity of the head case 24, to which the piezoelectric vibrators 15 that constitute the recording head 2 are attached, is enhanced, it is possible to suppress the compression deformation of the head case 24 when the recording head 2 performs a discharge operation and, thereby, it is possible to discharge a prescribed amount of liquid droplets from the nozzle openings 19 at a prescribed speed. As a result, it is possible to make the liquid droplets be placed on a discharged object with further high accuracy.

In addition, because the printer 1 has the mounted recording head 2 that is assembled in a state where the components are positioned with high accuracy, when the recording head 2 performs a discharge operation (recording operation), it is possible to discharge a prescribed amount of ink droplets from the nozzle openings 19 at a prescribed speed. As a result, it is possible to make the discharged ink droplets be placed on the sheet of recording paper 6 with further high accuracy. In this manner, it is possible to improve the quality of an recorded image.

Incidentally, the aspects of the invention are not limited to the above described embodiments, but they may be modified into various alternative embodiments on the basis of the scope of the appended claims.

For example, in the above described embodiments, the clearance step portion 63 is provided in the reinforcing plate 60; however, when the diaphragm portions (island portions 48) are less likely to interfere with the insertion opening portions 61 or the crosspieces 62, it is not necessary to provide the clearance step portion 63.

In addition, the aspects of the invention are not limited to the recording head of the printer, but they may also be applied to other liquid ejecting heads or liquid ejecting apparatuses. For example, the aspects of the invention may be applied to a display manufacturing device that manufactures a color filter of a liquid crystal display, or the like, an electrode manufacturing device that forms an electrode of an organic EL (Electro Luminescence) display, an FED (field emission display), or the like, and a chip manufacturing device that manufactures a biochip, or the like.

What is claimed is:

1. A liquid ejecting head comprising:

a flow passage unit that includes:

a liquid flow passage that at least includes a pressure chamber that communicates with a nozzle opening; and a diaphragm portion that is formed at a portion corresponding to the pressure chamber and that varies a volume of the pressure chamber;

a vibrator unit that includes a piezoelectric vibrator that is bonded to the diaphragm portion, wherein the piezoelectric vibrator displaces the diaphragm portion;

a case that has an accommodation chamber formed therein to accommodate the vibrator unit; and a reinforcing plate that has an insertion opening portion that is formed at a position corresponding to the diaphragm portion and through which a free end portion of the piezoelectric vibrator is insertable, wherein the reinforcing plate is interposed between the case and the flow passage unit, wherein the flow passage unit includes a plurality of the diaphragm portions that are provided in a column in correspondence with a plurality of the pressure chambers, and wherein the reinforcing plate includes a plurality of the insertion opening portions in correspondence with the diaphragm portions of the flow passage unit, and a crosspiece is formed between any adjacent insertion opening portions of the reinforcing plate.

2. The liquid ejecting head according to claim 1, wherein the reinforcing plate has a higher Young's modulus than the case.

3. The liquid ejecting head according to claim 2, wherein the reinforcing plate is formed of a silicon substrate.

4. The liquid ejecting head according to claim 1, wherein each of the case, the reinforcing plate and the flow passage unit have at least two positioning holes, wherein positions of the corresponding positioning holes of the case, the reinforcing plate and the flow passage unit are overlapped one another.

5. The liquid ejecting head according to claim 1, wherein the thickness of the reinforcing plate is set smaller than the length of the free end portion of the piezoelectric vibrator.

6. The liquid ejecting head according to claim 1, wherein the reinforcing plate has a clearance step portion that is formed on a face of the reinforcing plate, which is bonded with the flow passage unit, in an area, in which the insertion opening portion is formed, on a side of a face of the reinforcing plate, which is bonded with the case.

7. The liquid ejecting head according to claim 6, wherein the amount of setback of the clearance step portion of the reinforcing plate from a face bonded with the flow passage unit is set larger than the amount of displacement by which the diaphragm portion is displaced by the piezoelectric vibrator toward the case.

8. A liquid ejecting apparatus comprising the liquid ejecting head according to claim 1.

* * * * *